United States Patent [19]

Ogihara

[11] 4,072,829

[45] Feb. 7, 1978

[54] ATTACHMENT FOR LOUDSPEAKER

[75] Inventor: Kenzo Ogihara, Hachioji, Japan

[73] Assignee: Olympus Optical Co., Ltd., Tokyo, Japan

[21] Appl. No.: 718,927

[22] Filed: Aug. 30, 1976

[30] Foreign Application Priority Data

Sept. 1, 1975 Japan ..... 50-120506[U]

[51] Int. Cl.[2] ..... H04R 1/02

[52] U.S. Cl. ..... 179/146 R

[58] Field of Search ..... 179/1 E, 146 R, 178, 179/179, 180; 181/148

[56] References Cited

FOREIGN PATENT DOCUMENTS

| | | | |
|---|---|---|---|
| 2,334,665 | 1/1975 | Germany | 179/146 R |
| 2,425,717 | 12/1975 | Germany | 179/180 |
| 2,254,410 | 5/1974 | Germany | 179/178 |

*Primary Examiner*—George G. Stellar

*Attorney, Agent, or Firm*—Ostrolenk, Faber, Gerb & Soffen

[57] ABSTRACT

An attachment for a loudspeaker comprises an annular resilient frame which is formed in its inner peripheral surface with a groove which is adapted to receive therein an outer circumferential flange of the loudspeaker surrounding the opening thereof. The attachment is provided with means for securing it to a loudspeaker mounting surface.

4 Claims, 7 Drawing Figures

ATTACHMENT FOR LOUDSPEAKER

BACKGROUND OF THE INVENTION

The invention relates to an attachment for a loudspeaker, and more particularly, to such an attachment which may be utilized to mount a loudspeaker on a loudspeaker mounting surface of a loudspeaker cabinet or of a casing of an electroacoustic instrument.

A variety of attachments or mounts for loudspeakers have been provided and known. However, in a compact or miniature size electroacoustic instrument such as a radio set or tape recorder, the casing comprises either plastic material or light metal such as aluminium having a reduced wall thickness on the order of 1 millimeter for the convenience of its portable use, so that a loudspeaker incorporated into the casing cannot be directly mounted on the casing wall by means of set screws. Though a spot welding is available for a metal wall casing to anchor mounting studs for the loudspeaker, marks are left on the outer surface of the casings to degrade the appearance.

For mounting a loudspeaker on a casing having a reduced wall thickness, the following means are usually employed:

(1) A sleeve in which the outer periphery of the yoke of a loudspeaker is a close fit is intergrally formed in a parts supporting frame which is assembled into a casing. After the yoke is fitted into the sleeve, the frame is assembled into the casing in a manner such that the wall thereof bears against the peripheral flange extending around the opening of the loudspeaker, thus securing it in position.

(2) Where the casing is molded from a plastic material, a plurality of pedestals are integrally molded with the inner wall surface of the casing, and the loudspeaker is mounted on the pedestals by means of fasteners.

The latter arrangement is illustrated in FIG. 1 by way of example, where a plurality of pedestals 4 are provided on the inner wall (not shown) of the casing at locations which define the mounting position of a loudspeaker 2. The loudspeaker 2 is disposed inside the pedestals 4, and one end of fasteners 3 are clamped to the pedestals 4 by means of set screws 5. The other end of the fasteners 3 bears against the peripheral flange 2*a* of the loudspeaker to mount it on the casing wall. It wil be noted that the described arrangement requires a space for the provision of the pedestals 4 and also requires an increased number of parts and hence mounting steps for mounting the loudspeaker. Furthermore, the interposition of the fasteners between the loudspeaker and the inner wall of the casing causes a resonance thereof when the loudspeaker vibrates to produce sounds. The first mentioned mounting means which uses the sleeve secured to the supporting frame involves an additional space requirement for the provision of the sleeve and also involves a problem of rattling unless the loudspeaker is firmly held against the casing wall.

SUMMARY OF THE INVENTION

It is an object of the invention to provide an attachment for loudspeaker which eliminates the above disadvantages.

The attachment according to the invention comprises a resilient mounting frame having a groove into which the peripheral flange of a loudspeaker extending around the opening thereof is fitted. The frame is secured to a loudspeaker mounting position. The space requirement is minimized and the resonance is eliminated because of the resilient support of the loudspeaker. The number of parts required for mounting the loudspeaker is also minimized, and the mounting step is greatly facilitated. Where the casing comprises a metal material, unsightly marks of spot welding are avoided.

The edge of the resilient frame which retains the peripheral flange of the loudspeaker may comprise a semicircular edge portion and at least one arcuate edge portion. This facilitates a fitting of the peripheral flange of the loudspeaker into the groove since what is required is only turning the arcuate edge portion outside. The arcuate edge portion formed is isolated or separated from the remaining portion of the edge, it may be simply turned outside, permitting an easy and efficient mounting or dismounting of the loudspeaker on or from the frame even after the latter is secured to the casing wall.

DETAILED DESCRIPTION OF EMBODIMENTS

Figure 1:
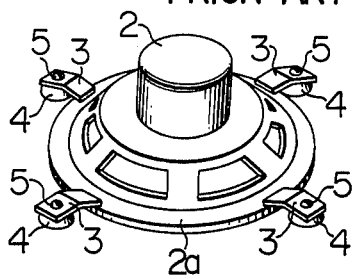
FIG. 1 PRIOR ART
FIG. 1 is a perspective view of a conventional attachment for a loudspeaker.
Figure 2:
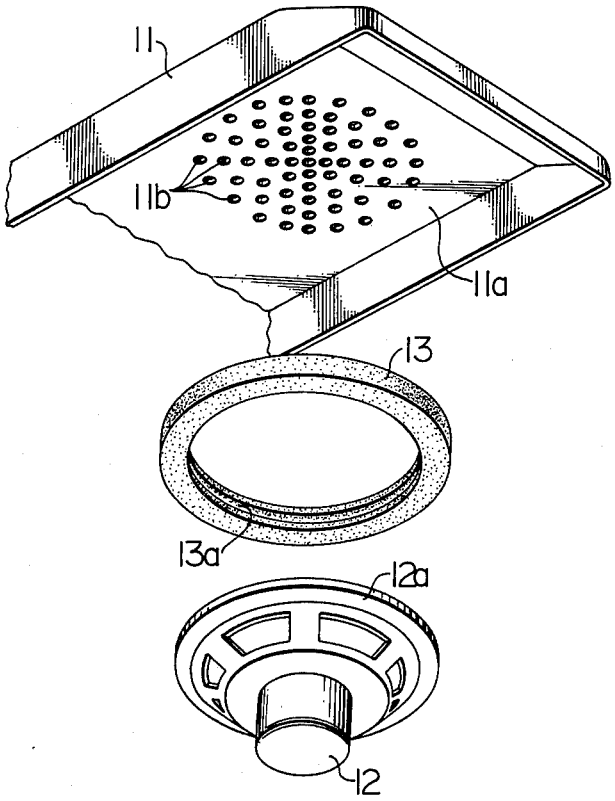
FIG. 2 is an exploded perspective view of the attachment for a loudspeaker according to one embodiment of the invention.
Figure 3:
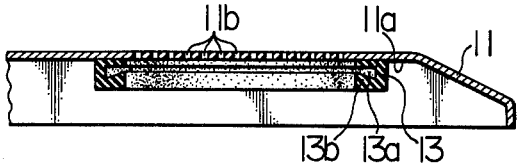
FIG. 3 is a cross section of the resilient frame used in the attachment.

Referring to FIG. 2, there is shown an exploded perspective view of the attachment for loudspeaker constructed in accordance with one embodiment of the invention. A generally circular loudspeaker 12 is intended to be mounted on the inner surface 11*a* of a casing 11, with its opening facing such surface. The surface 11*a* is formed with a multiplicity of air vent apertures 11*b* in its region which is in registry with the opening of the loudspeaker. A resilient mounting frame 13 is adhesively bonded to the surface in alignment with the loudspeaker mounting position. The frame 13 is molded from synthetic resin material or is formed of rubber into a configuration conforming to the outer periphery of the loudspeaker opening, which is annular in the example shown. The inner diameter of the annular configuration is chosen slightly less than the diameter of a peripheral flange 12*a* of the loudspeaker. The inner circumferential surface of the frame 13 is formed with a groove 13*a* adapted to receive the peripheral flange 12*a* in a tightly fit manner. As shown in the cross section of FIG. 3, the groove 13*a* has a varying width, which increases as further removed radially from the axis of the annular configuration. It will be also noted in FIG. 3 that at least one of lateral surfaces which define the groove is inclined as the width increases. In the example shown, the lower edge 13*b* of the groove has an inclined surface. The width of the groove at the bottom thereof is chosen equal to the thickness of the peripheral flange 12*a*.

Figure 4:
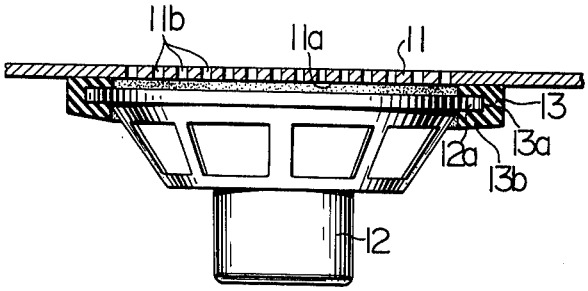
FIG. 4 is a cross section of the attachment of the invention, shown together with a loudspeaker fitted therein.

In use, the frame 13 is initially adhesively bonded to the inner surface 11*a* of the casing at a position where the loudspeaker should be located, and then the peripheral flange 12*a* is fitted into the groove 13*a* as indicated in FIG. 4, thus completing the mounting of the loudspeaker 12 on the wall of the casing 11. The tapered surface on the lower edge 13*b* serves to resiliently clamp the peripheral flange 12*a*, thus providing a firm support for and avoiding the rattling of the loudspeaker 12.

Instead of extending around the full perimeter of the flange 12*a*, the frame may extend through an angle which is intermediate 180° and 360°. Alternatively, the frame may comprise a plurality of circumferentially spaced, sector-shaped portions. In this instance, the flange of the loudspeaker may be laterally inserted into the grooves formed in the inner circumferential surface of the respective portions.

Figure 5:
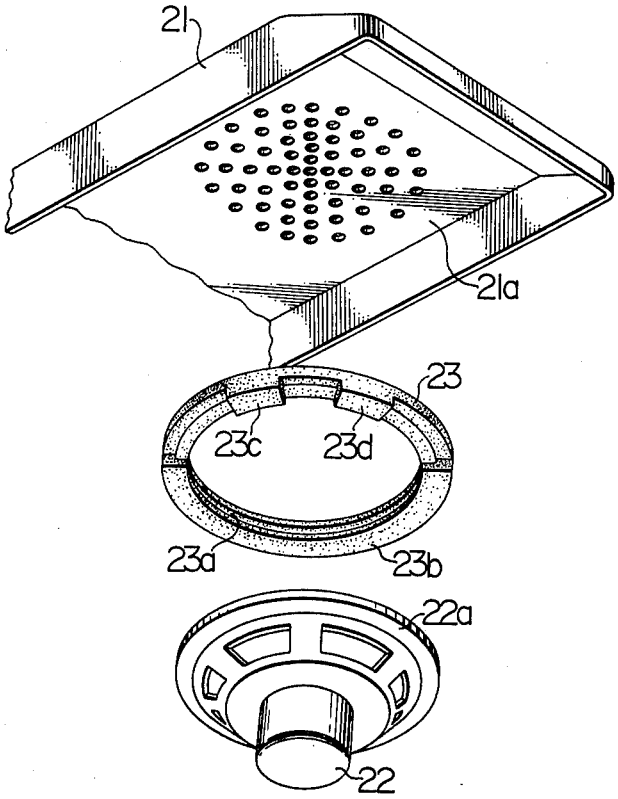
FIG. 5 is an exploded perspective view of another embodiment of the attachment of the invention.

FIG. 5 shows another embodiment of the invention. A casing 21 has an inner surface 21*a*, to a predetermined area of which is adhesively bonded a resilient mounting frame 23, which is again formed of rubber or molded from a synthetic resin material into an annular configuration. As before, the frame 23 is formed with a groove 23*a* formed in its inner circumferential surface for receiving the peripheral flange 22*a* of a loudspeaker 22. However, in contradistinction to the frame 13 of the previous embodiment, the lower edge of the groove 23*a* comprises a semi-circular edge portion 23*b* and a pair of sector-shaped edge portions 23*c*, 23*d*, with the remaining edge between them removed. Specifically the edge portion 23*b* subtends an angle of approximately 180°, and each of the edge portions 23*c*, 23*d* subtends an angle of nearly 10° and is suitably noted on the remaining perimeter of the frame 23.

Figure 6:
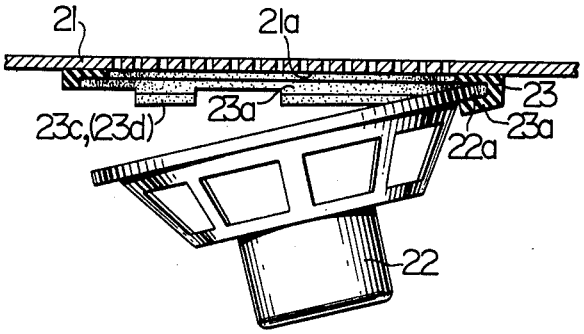
FIGS. 6 and 7 are cross sections of the attachment shown in FIG. 5, illustrating a procedure of fitting the loudspeaker in place.
Figure 7:
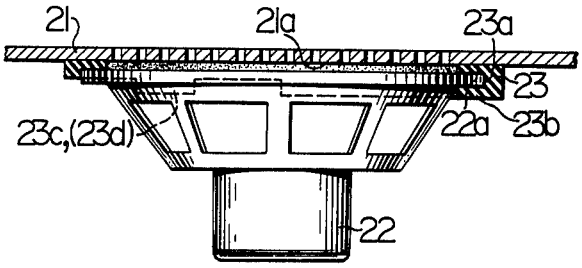

In use, the peripheral flange 22*a* of the loudspeaker 22 may be partly fitted into the groove 23*a* by laterally sliding it along the semi-circular edge 23*b*, as shown in FIG. 6, and then the two sector-shaped edge portions 23*c*, 23*d* turned outside to fit the flange into the groove entirely, whereupon the edge portions 23*c*, 23*d* may be released. By resilience, these edge portions return to their original position (see FIG. 7), thus cooperating with the semi-circular edge portion 23*b* to firmly hold the flange against rattling.

It will be noted that instead of providing the pair of sector-shaped edge portions, only one of them may be provided.

What is claimed is:

1. An attachment for a loudspeaker comprising a resilient mounting frame of a configuration conforming to the outer periphery of a loudspeaker and extending around an opening thereof, a groove formed in the inner circumferential surface of the frame for receiving the peripheral flange of the loudspeaker has a tight fit, and means for bonding the frame to a loudspeaker mounting surface;

the said frame is annular in configuration, the edge of the groove which is remote from the edge bonded to the mounting surface comprising a semi-circular edge portion and at least one sector-shaped edge portion spaced from the semi-circular portion and subtending an angle of the order of 10°.

2. An attachment for a loudspeaker comprising a resilient mounting frame of a configuration conforming to the outer periphery of a loudspeaker and extending around an opening thereof, a groove formed in the inner circumferential surface of the frame for receiving the peripheral flange of the loudspeaker has a tight fit, and means for bonding the frame to a loudspeaker surface;

the width of the said groove increasing with depth, with an edge of the groove which is remote from the edge being bonded to the mounting surface having an inclined inner surface.

3. The attachment for a loudspeaker of claim 2 in which the said frame is annular in configuration, the edge of the groove which is remote from the edge bonded to the mounting surface comprising a semi-circular edge portion and at least one sector-shaped edge portion spaced from the semi-circular portion and subtending an angle of the order of 10°.

4. The attachment for a loudspeaker of claim 3 in which two of said sector shaped edge portions are used.

* * * * *